US005970759A

United States Patent [19]

Trilk

[11] Patent Number: 5,970,759

[45] Date of Patent: Oct. 26, 1999

[54] CHANGEOVER DEVICE FOR A DOOR OR WINDOW FITTING

[76] Inventor: Hartmut Trilk, Gotzkowskystrasse 18A, Berlin, Germany, D-10555

[21] Appl. No.: 09/000,081

[22] PCT Filed: Jul. 19, 1996

[86] PCT No.: PCT/DE96/01381

§ 371 Date: Apr. 9, 1998

§ 102(e) Date: Apr. 9, 1998

[87] PCT Pub. No.: WO97/04203

PCT Pub. Date: Feb. 6, 1997

[30] Foreign Application Priority Data

Jul. 19, 1995 [DE] Germany ..... 195 27 796
Oct. 5, 1995 [DE] Germany ..... 195 38 517

[51] Int. Cl.[6] ..... E05B 47/00

[52] U.S. Cl. ..... 70/277; 70/256; 70/224; 70/472; 70/149

[58] Field of Search ..... 70/256, 277, 278–218, 70/224, 472, 481, 149

[56] References Cited

U.S. PATENT DOCUMENTS

| | | | |
|---|---|---|---|
| 777,885 | 12/1904 | Dieringer | 70/472 X |
| 1,090,772 | 3/1914 | Wilson . | |
| 1,940,018 | 12/1933 | Rymer | 70/472 |
| 2,662,387 | 12/1953 | Hagstrom | 70/472 |
| 4,631,944 | 12/1986 | Gater et al. | 70/472 |
| 4,920,773 | 5/1990 | Surko, Jr. | 70/224 |
| 5,010,752 | 4/1991 | Lin | 70/277 |
| 5,018,375 | 5/1991 | Tully | 70/472 |
| 5,040,391 | 8/1991 | Lin | 70/277 |
| 5,372,025 | 12/1994 | Lin | 70/472 |
| 5,421,178 | 6/1995 | Hamel et al. | 70/472 X |
| 5,447,047 | 9/1995 | Lin | 70/277 X |
| 5,513,510 | 5/1996 | Solovieff et al. | 70/472 |
| 5,791,177 | 8/1998 | Bianco | 70/278 |

FOREIGN PATENT DOCUMENTS

| | | | |
|---|---|---|---|
| 477028 | 1/1976 | Australia . | |
| 546394 | 8/1985 | Australia . | |
| 123 947 | 2/1900 | Germany . | |
| 670 268 | 1/1939 | Germany . | |
| 303 055 | 5/1954 | Germany . | |
| 1 113 649 | 3/1962 | Germany . | |
| 7 216 046 | 7/1972 | Germany . | |
| 78 20 998 | 12/1978 | Germany . | |
| 38 44 281 | 6/1989 | Germany . | |
| 7045 | 5/1893 | United Kingdom | 70/472 |
| 91/00061 | 10/1991 | WIPO . | |

OTHER PUBLICATIONS

International Search Report corresponding to PCT/DE 96 01381.

Derwent Abstract corresponding to 38 44 281.

*Primary Examiner*—Suzanne Dino Barrett
*Attorney, Agent, or Firm*—Darby & Darby

[57] ABSTRACT

A switch for a door or window has inner and outer handles which are both axially fixed to withdraw the locking element of any type of lock. The switch has an actuating shaft which extends between the inner and outer handles for withdrawing the locking element. The actuating shaft has overall dimensions which represent the only dimensions allowing the switch to fit into the lock. An actuating element associated with the inner handle is used to selectively set at least two states of operation of the outer handle. A transmission element inwardly linked to the actuating element extends between the inner and outer handles at least in an area of the actuating shaft that extends through the lock and within the limits of its overall dimensions. A coupling device associated to the outer handle is integrated as a closed unit into the outer handle for putting the outer handle in its selected state of operation, and in particular for selectively coupling or uncoupling the outer handle and the actuating shaft, so that the outer handle may swivel into all of its states of operation.

29 Claims, 10 Drawing Sheets

CHANGEOVER DEVICE FOR A DOOR OR WINDOW FITTING

BACKGROUND OF THE INVENTION

1. Field of the Invention

The invention relates to a changeover device for a door or window fitting and to a door, gate or window fitting having such a changeover device.

2. Description of the Prior Art

Door or window fittings with means for changing over between various operating states are known.

For example, turn and tilt fittings for windows are in widespread use, making it possible to open the window both about a vertical and about a horizontal axis of rotation or else keeping the window locked.

DE-B-11 13 649 discloses a door fitting, in which the door handle can be uncoupled from the associated lever spindle by means of a coupling. This fitting makes it possible, in one position of a coupling, to rotate the lever spindle and consequently open (or close) the door, whilst, in a second position, the door handle can be rotated freely, without the lever spindle rotating and without the door being able to be opened (or closed).

DE 78 20 998 U discloses a window fitting for swinging casement windows, in which a handle, rotatable in an escutcheon or a rose and having a boltlike integrally formed portion for engagement into a striking plate, is assigned a pushbutton-actuated blocking part, by means of which the handle can be prevented from being actuated.

In these and other known fittings, a changeover between the operating states takes place on that side of the fitting (that is to say of the door or window) on which the changeover also takes effect.

There are also known possibilities for selectively allowing or preventing the opening of a door from one side (outside) or from the other side (inside).

Not only conventional locks for locking a door by means of a key actuated lock bolt are generally known here, but also the locking devices of bathroom or WC doors, in which a detent bolt provided in addition to the spring-actuated snap bolt (of the latch) is pushed behind an associated striking plate via an internally arranged rotary grip (handle, knob), after which actuation of the external lever causes the snap bolt to be drawn back, but does not cause the door to open.

When a door is barred by means of a key, any passage through the door whenever the latter is to be kept barred involves a double actuation of the lock. This is too complicated in many instances occurring in practice, for example for authorities where there is usually public access, but in which admittance has to be controlled, or for stores, after they have closed, when there are still customers in the store and it must be possible for them to leave it. The more employees work in a room or section of a building, the more difficult this solution becomes in terms of organization and cost. Furthermore, "self-confinement" must be regarded as unfavorable from the point of view of protection of labor (the presence of nonbarred escape routes) and from considerations of work psychology.

Moreover, door openers have been known for a long time, particularly from the entrance areas of companies, authorities, etc., the functioning of these door openers being based on an electromechanically remote-controlled drawback of the abutment for the snap bolt in the door frame. The greatest disadvantage of this solution is that its execution, particularly in the form of retrofitting, necessitates a high outlay for electrical installation and, particularly in the case of safety doors, the modification of the frame.

German Utility Model 1,683,917 discloses a door handle which can be locked on one side and in which the external lever handle is inactivated as a result of the axial displacement of a projecting lever on the internal lever handle and the external lever handle is fixed in the inactive state. It is no longer possible for the door to operate idly in this operating state. However, since the user recognizes that the external lever handle is a handle for moving the door, this principle entails the risk of accidents on two counts, on the one hand because the absence of movability of the external lever handle in the inactive state is contrary to its visual appearance, on the other hand due to the axial displaceability of the adjusting lever relative to the door leaf, which leads to the risk of jamming.

German Patent Specification 670,268 describes a handle arrangement with two handles independent of one another and having a displaceable coupling member which, however, in order to be fitted, requires a modification of the lock. This arrangement is therefore scarcely suitable for retrofits.

U.S. Pat. No. 1,090,772 discloses a door locking arrangement, in which the changeover between the active/inactive operating states of the external handle is carried out by means of an axially displaceable internal handle. The result of the absence of axial fixing of the internal handle is that, when the internal handle is actuated, a change of state of the external handle may take place unintentionally. Moreover, this design entails a distinct risk of jamming, so that the arrangement does not meet current requirements relating to the protection of labor.

German Utility Model 72 16 046 discloses a mortise lock having two rotary grips (external/internal lever handle), with means which ensure that it is easier to unlock the door from outside by means of a key belonging to the lock. Here too, the changeover in operating states takes place as a result of an axial displacement of the internal handle, with the corresponding risks of accidents. Moreover, in order to provide the square perforation, the follower must have a dimension differing from the conventional dimension, in particular be widened subsequently, so that this arrangement, too, is somewhat unsuitable for retrofits.

SUMMARY OF THE INVENTION

The object on which the invention is based is, therefore, to specify a changeover device of the generic type initially mentioned, which is easy to actuate, is harmless from the point of view of protection of labor and work psychology and can be retrofitted at low outlay in the case of commercially available snap bolt locks. In particular, it should not entail any risks of jamming or necessitate any modification in the structure of the door lock.

This object is achieved by means of a changeover device having the features of claim 1.

The invention embraces the notion of providing an arrangement which is fully integrated into the fitting, avoids the need for axial displacement of externally accessible parts and does not require any modifications on the frame, window casement or door lock. Said arrangement can be executed universally and in a simple way with different lock systems and avoids risks of accident which arise from a fixing of the external handle and from axially displaceable actuating elements. It thus satisfies the current strict licensing regulations for use in public buildings and allows retrofitting in conjunction with door locks certified for insurance purposes.

The invention also embraces the notion of providing, on the inside, an actuating element (also referred to further, together with the internal handle, by the term "shift lever handle") which is assigned to the internal handle and which is connected to an operative element assigned to the external handle (by virtue of which operative element, the external handle is also referred to further by the term "operating lever handle") via a transmission member extending essentially within the outer contour of the square spindle. This transmission member, in turn, connects the external handle to the actuating shaft of the bolt, that is to say, in the case of the commercially available snap bolt lock, to the square spindle via the follower. The connection between the actuating element and the operative element is made by means of a shiftable (particularly engageable/disengageable) coupling means which can be executed in a variety of designs.

A fitting equipped with the changeover device according to the invention is provided, in particular, for external and internal doors and gates and may be used in exchange for the most diverse commercially available handles and fitting parts, the constructional and aesthetic specifications of these being preserved.

Different external access authorizations can be set selectively from inside. The decisive practical advantage of the changeover and operating fitting designed according to the invention is that a plurality of functions are combined in a single fitting so as to meet current requirements as to safety and the protection of labor, whilst alternative external access authorizations can be set from inside and the predetermined safety locking function of the lock system used is not changed. The changeover and operating fitting works independently of the bolting and locking mechanism used in the lock, the opening of the door from inside not being subject to any selection of function, so that it is always possible to open nonlocked doors or gates from inside the room.

The changeover and operating fitting can be employed particularly advantageously in public administration buildings, in rooms where the public has access only temporarily. During times when there is no public access or all the service counters are already occupied, the officers can bar external access authorization from inside the room, without a key being actuated. However, the officers themselves can leave the room directly at any time (likewise without having to manipulate a key). When access is to be permitted again, an actuating element is operated from inside the room, and anyone may then enter the room from outside. By contrast, in the case of a room door with a conventional fitting, it would be necessary, during an access prevention phase, that the room be opened from inside, passage take place through the door and, subsequently, the door be locked again from outside.

Other examples of use may be found in many commercial and private sectors, for example in laboratories, business premises, as childproof safety devices, for garden gates, etc. It must be emphasized particularly, in this case, that the lock system to be used is optional, so that any locking safety function from outside and inside can be implemented by selecting the corresponding lock and locking system. Multifunctionality can be achieved particularly cost-effectively simply by exchanging an existing fitting on doors or gates.

In a preferred version of the changeover and operating fitting, the following three setting or operating states can be set from inside the room by adjusting an integrated changeover element on the fitting:

Operating state A) Release: Door or gate opening from outside possible

Operating state B) Permanent locking: Door or gate opening from outside not possible Operating state C) Partial locking: Door or gate opening until the internal lever handle/rotary knob has been actuated once.

In the operating state A (external handle is active), the changeover and operating fitting is comparable to a conventional door fitting with an external and an internal lever handle (or corresponding rotary knobs). The door is opened by actuating or drawing back the bolt element (snap bolt) integrated in the lock.

In the operating state B (external handle is inactive), the changeover and operating fitting can be compared in functional terms to a conventional door fitting with a fixed external knob and an internal lever handle. Opening from outside is prevented in that it is not possible to draw back the snap bolt as a result of uncoupling between the external handle and the actuating shaft of the snap bolt. In this state (idling), a rotatable external handle remains rotatable, so that there is no risk of accidents, as entailed by a handle which is fixed (contrary to the external appearance of movability).

The operating state C cannot be compared with a function of conventional door fittings; it basically involves an additional preselection or memory function as regards the two possible operating states of the external handle. In the main use of this operating state, a person sets a temporary external access bar from inside the room, until the time when he himself leaves the room through the door barred on the outside and would like to make it possible for himself to re-enter the room directly.

In a special design of the changeover and operating fitting, only the states A and C can be set on the internal fitting, but not the state B, so that this is the preferred design variant for lock systems which do not provide any drawback of the lock bolt by key actuation and in which there would therefore be the risk of locking oneself out in the state B.

The transmission and coupling means connecting the internal actuating element and the external operative element to one another can bring about the setting effect on the basis of different physical principles; it may, for example, be designed in such a way that the connection between the actuating element and operative element is made via a fluid (a hydraulic fluid, compressed air or the like) or an electrical and/or magnetic field. However, mechanical means are preferred for most areas of use, said means having an essentially rigid tensile force and/or compressive force or torque transmission member and a directional catch mechanism (a "freewheel") capable of being changed over by means of a tensile or compressive force or a torque and connected to the transmission member.

The transmission member may be double-acting, that is to say all the changeovers between the operating or setting states are brought about actively. This may necessitate, in particular, transmission both of tensile force and compressive force or of a torque in directions of rotation opposite to one another and, consequently, the design of the transmission member with a construction suitable for this purpose and from suitable materials, for example as a pull/push rod or right/left rotary sleeve.

Alternatively, however, a torque transmission member transmitting only tensile force or only compressive force or acting in only one direction of rotation and, in addition to this, a return member acting automatically counter to the direction of action of said transmission member and, in particular, designed as a spring element may also be provided. In an advantageous design of this type, a pull rope or pull band running essentially parallel to the longitudinal axis of the actuating shaft of the fitting bolt, in particular in a bore or circumferentially arranged recess of said shaft is provided as a tensile force transmission member or a correspondingly arranged push rod is provided as a compressive force transmission member.

This design allows particularly easy use with commercially available standardized snap bolt locks, the follower/snap bolt subassembly of which does not have to be changed at all, and with commercially available fitting systems, the mechanism, handles and striker plates or roses of which likewise do not have to be modified or have to be modified only slightly.

In an advantageous design with a construction adapted to the standardized construction of snap bolt locks, the operative element provided on the external handle has a molding which is selectively in engagement or out of engagement with the square spindle for actuating the latch and which possesses one or more first operative faces, via which said molding can be connected to an engagement part of the coupling means, said engagement part being movable into or out of engagement with the molding between at least two different positions and itself having a second operative face which is designed to correspond to the first operative face (for example, as a "negative" of this).

The design of the actuating element must be adapted to the instance of use. In a simple and cost-effective embodiment which can be operated easily, together with a pressdown handle or a lever handle, with one hand, the actuating element is designed as a rocker lever arranged on the lever neck or as a rotary ring surrounding the lever neck, said rocker pressdown handle or rotary ring having, in particular, a common axis of rotation with the internal handle designed as a pressdown handle. However, the axis of rotation of the rocker lever may also form an angle with that of the pressdown handle and be capable of being actuated by being pulled or pressed by the thumb or finger.

As regards the above explanations of the operating or setting states A, B and C (also referred to further below, in the description of an embodiment, by "0", "II" and "I"), the design of the changeover device for setting precisely the two operating states or "inactive" of the external handle and the provision of means for changing over to the "active" state from the "inactive" state purely by actuating the internal handle (once) are preferred as a design which can be used universally.

In this case, particularly for fittings, in which it is not possible to draw back the latch by means of a key, the actuating element may simply allow the selective setting of the state "active" or of the state in which there is a changeover to the state "active" by the actuation of the internal handle. For other fittings or if, in addition, a safety unlocking function, described in more detail further below, is incorporated, the actuating element will have three setting possibilities, namely for the selective setting of the "active" state, of the "inactive" state or of the state (to be referred to as "temporary release") in which there is a changeover to the "active" state by the actuation of the internal handle.

Increased safety against locking oneself out or against practical jokes and the possibility of performing secondary locking functions are afforded by the provision of safety or additional changeover means which allow at least unidirectional changeover between operating states from the external handle, in particular a changeover from the "inactive" state or the "active" state.

The coupling means or the actuating and transmission mechanism is preferably designed in such a way that, when the changeover device is fitted, as an operating state of the external handle in its basic position, the "active" state (in the case of a door also referred to as an "opening door", for example an internal door) or the "inactive" state (in the case of a door referred to as a "barring door", in particular an external door) can be selectively predetermined.

The safety changeover means comprise, in a simple and cost-effective design, an orifice in the external handle (or in the region of the associated rose), via which orifice the operative element and/or the coupling means is accessible and the position of these can be changed. A change of position may be carried out, for example, by means of a ballpoint pen refill, pocket knife blade or nail file or such like parts, inserted into the orifice, which do not belong to the changeover or fitting system and constitute an easily accessible emergency tool.

For the expedient interlinking of a plurality of the above-mentioned operating features, in a preferred design, the actuating and transmission mechanism has a detent and return mechanism for the selective setting of a bistable operating mode changeover state which automatically puts the actuating element into a basic position ("0") when the internal handle is actuated or when a safety tripping means outside the door is actuated or as a result of a movement of an additional operative element which, in particular, is connected to the bolt element of the lock. This version eliminates the risk of locking oneself in or out due to automatic changeover when the door locks itself.

The use of a changeover device with right-striking and left-striking doors or windows is simplified by a symmetrical design of the coupling means, such that the changeover device can be used in one and the same version with right-striking and left-striking doors, gates or windows. An increase in usefulness by a simplification in operation is achieved, in this case, by designing the actuating mechanism symmetrically, in such a way that the direction of actuation can be selected uniformly (for example, clockwise or counterclockwise, irrespective of the door striker).

According to a further advantageous embodiment, operating state or setting state indicator means acting externally and/or internally are provided. An internal indication can be implemented in a simple way by suitably designing the actuating element itself or an indicating face or the like adjacent to the latter, and an external indication can be implemented by a separate indicator element linked to the coupling means or to the operative element.

In addition to manual actuation directly on the fitting, in a particularly convenient, but also more complicated version, a remote control is provided, that is to say the actuating element has means for remote actuation, particularly by radio. These means may be formed, in particular, by a convention infrared remote control, as is known from automobile central locking systems. In this case, the remote control means as a whole may also comprise at least parts of the coupling means, so that functional integration of the actuating element and coupling means may be obtained, without thereby departing from the scope of protection of the invention, just as little as by virtue of an integration of the operative element into the coupling means.

The fitting, in which the changeover device according to the invention is used, may be designed (in the way which is certainly the most widespread) in such a way that the internal and external handles are designed in each case as a pressdown handle (lever handle) pivotable about a common horizontal axis of rotation and connected or connectable to an actuating shaft for a spring-actuated latch as a bolt element.

However, the changeover device may also be used in the case of fittings in which at least the external handle is designed as a movable door press plate or as a door press bar connectable to an actuating shaft for the bolt element.

For both (and other) versions, it is advantageous to provide spring means, active independently of the operating state, for returning the external handle into the state of rest, since a fitting thus equipped conforms to the usual behavior in operating the handle and avoids an irritating visual appearance.

To increase safety against intrusion even further, it may be advantageous for many areas of use to provide, on the external handle, means for recording an actuation of the changeover device from outside or destructive action on this or to provide, on the coupling means or the operative element, means for recording the actual operating state and an alarm means connected to the recording means. This purpose may be achieved, for example, by electric contacts on the safety changeover orifice, in conjunction with a weak-current detection means, or by a light barrier or the like arranged at the same point. The alarm means may be arranged directly on the fitting on the inside of the door and/or in a central monitoring station.

BRIEF DESCRIPTION OF THE DRAWINGS

Advantageous developments of the invention are defined in the subclaims or are illustrated in more detail below, together with the description of preferred embodiments, with reference to the Figures in which:

DESCRIPTION OF THE PREFERRED EMBODIMENT(S)

Figure 1A:
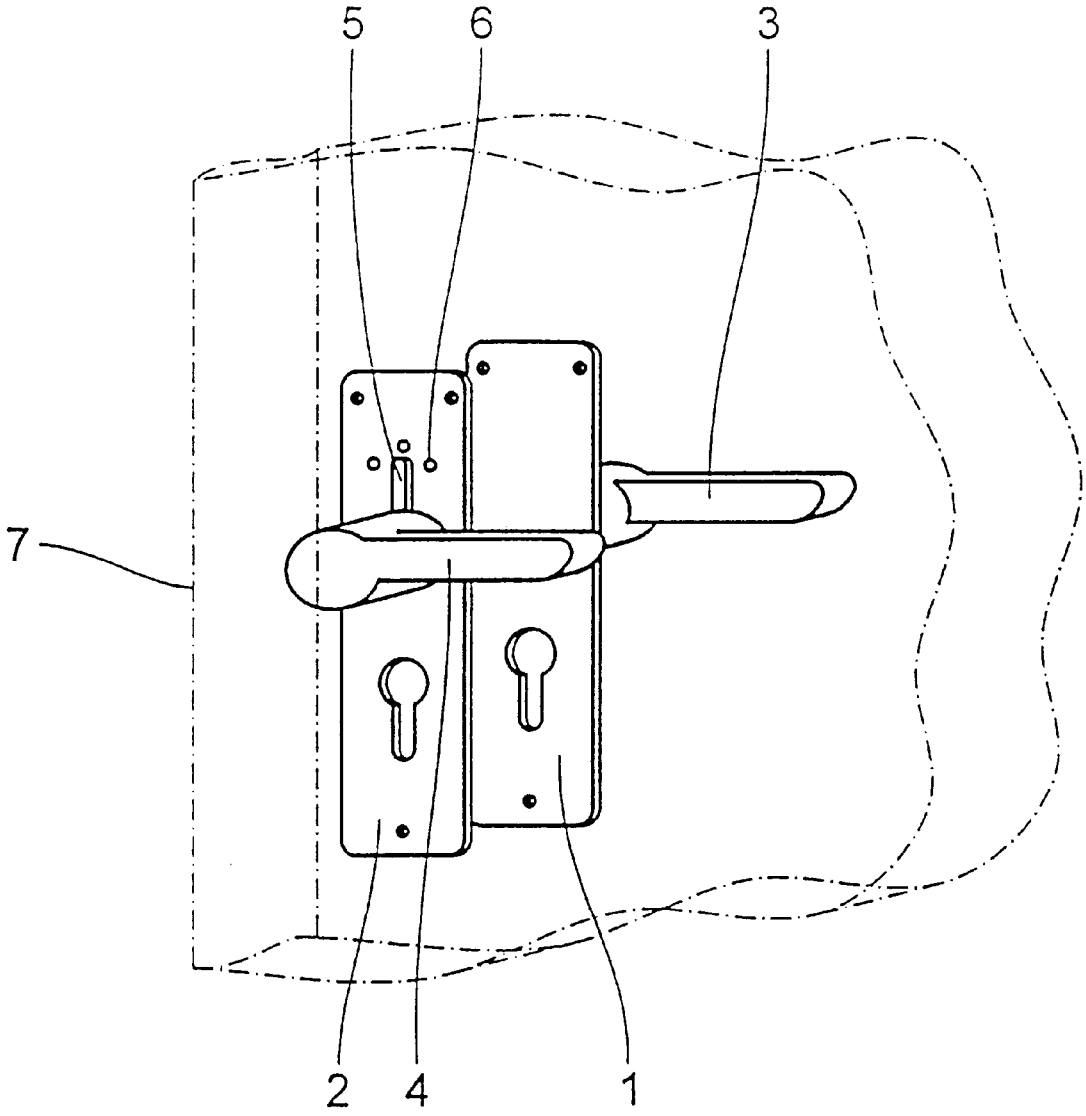
FIG. 1*a* shows an oblique view of a diagrammatic illustration of the externally visible fitting parts of a door fitting, in which a changeover device according to one embodiment of the invention is fitted.

FIG. 1*a* gives a diagrammatic illustration of the parts of a door fitting which are externally visible when the door 7 (represented as a cutout by broken lines) is imagined to be closed, with a changeover device according to one embodiment of the invention, as seen from the inside of the door. The fitting is composed of an external lock cover 1, an internal lock cover 2, an external operating handle, illustrated here as an external lever handle or pressdown handle 3, an internal handle, illustrated here as an internal lever handle 4, and a rotary lever 5 as a manual actuating element for the actual changeover device (switching element) for setting the operating state of the fitting. The fitting illustrated has three setting states which are indicated on the internal lock cover on a switching state indicator 6 directly utilizing the position of the rotary lever for indication: a state in which the external lever handle is permanently active, a state in which it is permanently inactive and a state in which it is inactive, but is activated by actuating the internal lever handle (the actuating element at the same time jumping back into the "active" state).

Figure 1B:
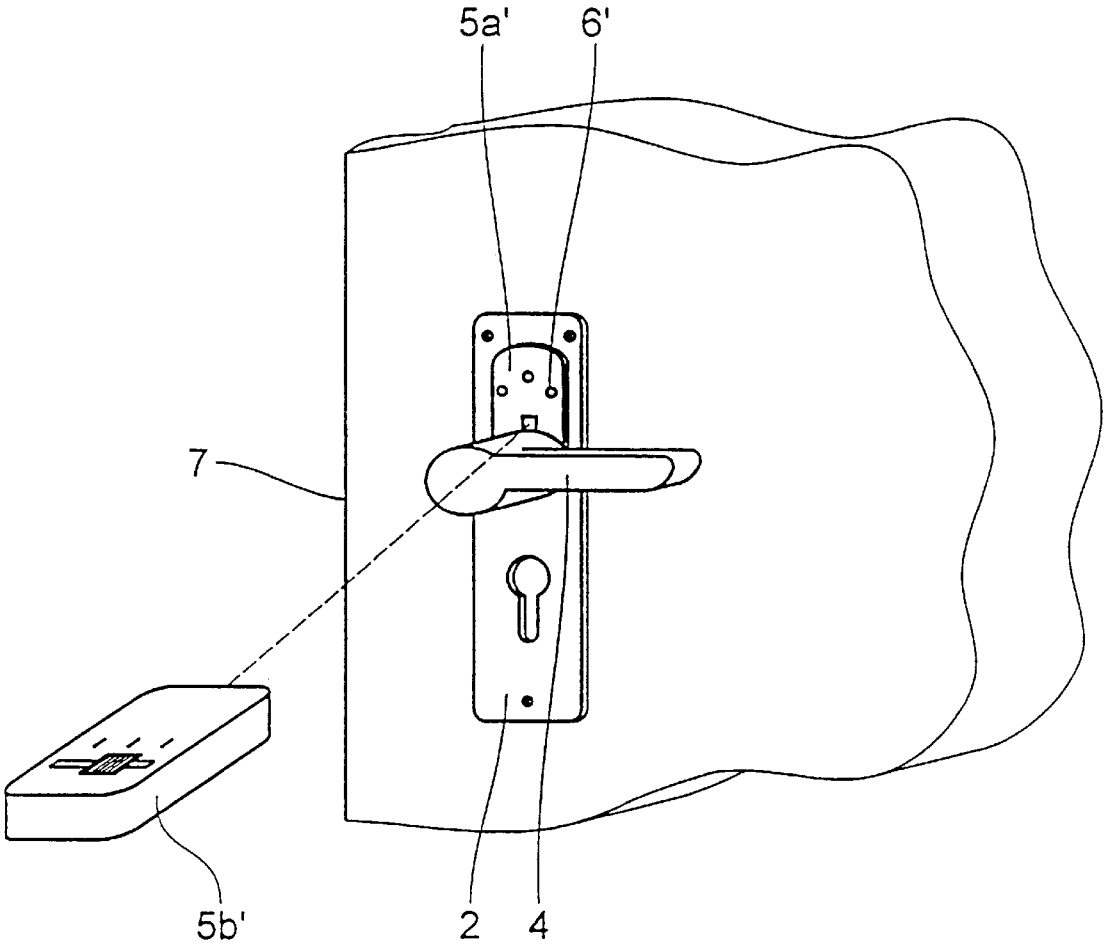
FIG. 1*b* shows a diagrammatic illustration of the visible fitting parts inside the room and of a transmission unit of a door fitting in a remote actuation version modified, as compared with FIG. 1, FIGS. 2*a* to 2*c* show in each case diagrammatic cross-section illustrations (in a horizontal sectional plane perpendicular to the plane of the door leaf) of door fittings with a changeover device according to basic embodiments of the invention.

FIG. 1*b* is a diagrammatic illustration of the visible parts of a door fitting which are inside the room, in a version which is modified, as compared with FIG. 1*a,* and in which the changeover device is actuated via an infrared remote control (known as such) with a transmission unit 5*b'* and via a reception and setting unit 5*a'* which is integrated into the internal door fitting and which may have an electromagnetic actuator, a servomotor or the like. A light-emitting diode indicator 6' for indicating the set operating or preselection state is provided on said reception and setting unit is provided on the infrared remote control. The remaining components correspond to those of FIG. 1. This version may be used particularly advantageously in relatively large work premises of authorities where there is frequent public access, management offices or the like, where manual actuation directly on the door fitting is to be considered as a not sufficiently convenient or technically demanding solution.

Figure 2A:
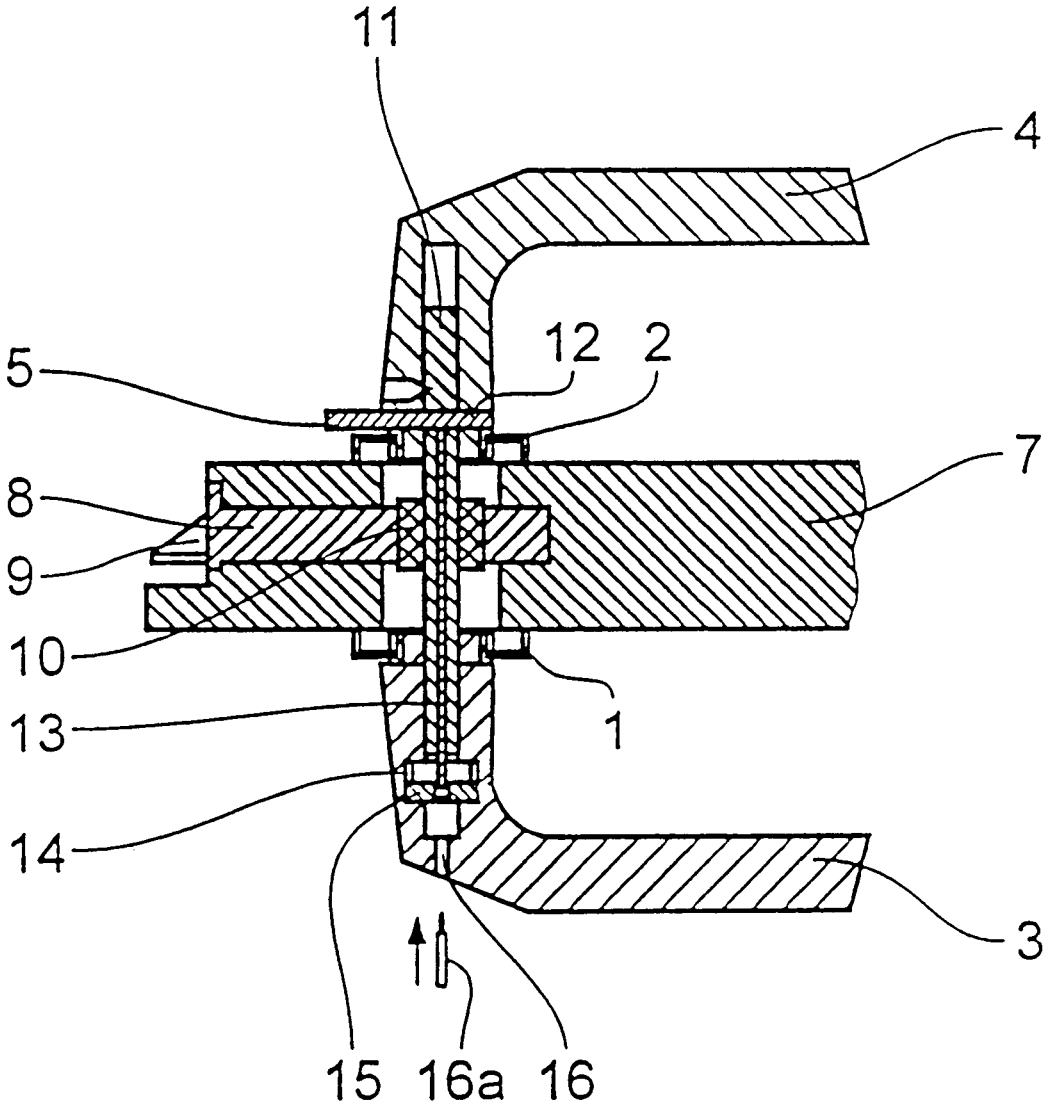

FIG. 2*a* illustrates, as a basic functional diagram, a horizontal sectional illustration of the fitting shown diagrammatically in the external view in FIG. 1*a.* This shows, as the main components of a standardized snap bolt lock or latch lock 8 which can be used in any way desired, a snap bolt (latch) 9 and a square through-element (a so-called follower) 10 which correspond to those of the standardized lock. The external lever handle 3 of the changeover and operating fitting is connected to the internal lever handle 4 in a similar way to a conventional version via a modified square spindle 11 as an actuating shaft for the snap bolt 9. In contrast to a conventional spindle, the square spindle 11 is provided with an axially continuous recess (not designated separately in this Figure) and is connected to the follower 10 in the conventional way by positive mechanical connection. Its end projecting into the external lever handle 3 is machined rotationally symmetrically, so that it is not, in itself, connected positively to the external lever handle.

The square spindle 11 is assigned a movement direction converter 12 (on the internal lever handle 4) and a transmission and coupling mechanism 13 which connect the rotary lever 5, arranged on the inside of the door, to an operative element 15 for activating and inactivating the external lever handle 3.

The movement direction converter 12, shown merely symbolically here, converts a rotational movement of the rotary lever 5 into an axial displacement of the operative element 15. The latter is itself selectively in engagement or out of engagement with a sleeve like engagement element 14 on the external lever handle 3. As a result of a rotation of the rotary lever 5, the operative element 15 is displaced axially, that is to say parallel to the square spindle 11, in order to produce or cancel the desired state of engagement with the engagement element 14 and consequently, selectively, an operative connection between the external lever handle 3 and square spindle 11 and thus, ultimately, between the external lever handle 3 and the latch 9. How this takes place in particular depends on the actual design of the coupling means in particular and is described in more detail further below by the example of special embodiments.

In the version shown, there is provided in the external lever handle 3 an (optional) passage bore 16, into which a ballpoint pen refill 16*a*, a wire or the like can be introduced and, consequently, the operative element 15 pressed into the engagement position from outside, even when engagement was originally released from inside. The bore 16 thus functions (together with the ball point pen refill) as a safety opening means, via which the integrated switching and operating mechanism can be adjusted in such a way that a door barred from inside can be safety-opened from outside.

The preselection function, mentioned further above, in which a changeover takes place from the "inactive" state to the "active" state as a result of the actuation of the internal lever handle instead of the rotary lever, may be performed by means of bistable mechanical switching arrangements know per se (for example a detent disk with spring elements), and the mechanism required may be integrated into the fitting parts of the region of the internal lever handle.

Figure 2B:
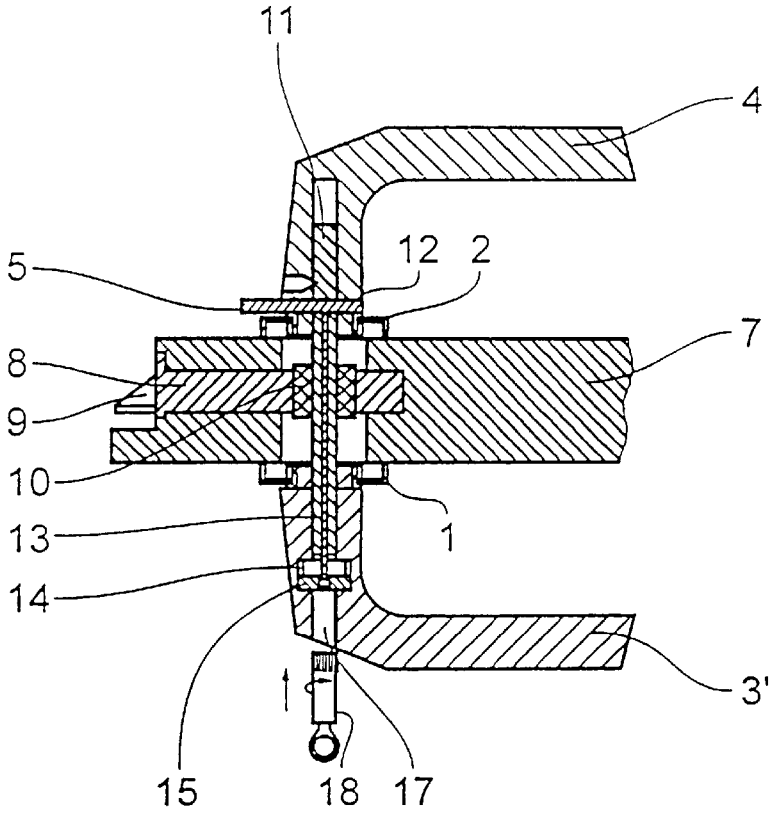

FIG. 2*b* is an illustration of a version, slightly modified, as compared with FIG. 2*a*, of a fitting in which the external lever handle 3 has, instead of a simple cylindrical passage bore, a lock orifice 17 with coding recesses and in the system a suitable key 18 is provided, by means of which the barred door 7 can be opened from outside in a similar way to the fitting described above. The remaining parts correspond to those shown in FIG. 2*a* and are not described again. In a development (not illustrated here), the external lever handle may have a commercially available displaceable and adjustable lock cylinder, via which the operating state of the external lever handle or handle can be set permanently by means of an associated key.

Figure 2C:
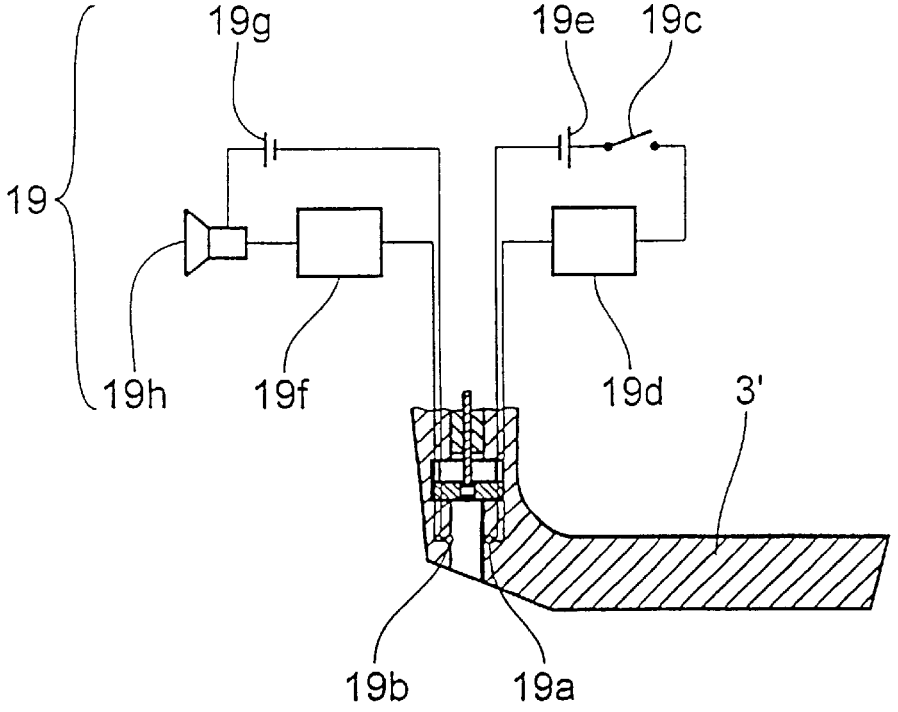

FIG. 2*c* is a basic illustration of a further embodiment which is modified, as compared with FIG. 2*a*. Here, the external lever handle 3 is provided with transmission and reception elements 19*a*, 19*b* of a mini-light barrier arrangement 19 which are arranged opposite one another on the circumference of the cylindrical passage bore 16. The transmission element 19*a* (for example, an LED) is connected to a voltage source 19*e* via a switch 19*c* (which may be mounted on the inside of the door) and a driver 19*d*, and the reception element 19*b* is connected to an alarm generator 19*h* via a signal processing stage 19*f* and a power supply 19*g*. When the arrangement 19 is in the activated state, that is to say with the switch 19*c* closed, the alarm generator emits an alarm signal if the light beam passing through the orifice 16 is interrupted as a result of the introduction of a tool for unlocking the lock. Here too, the remaining parts illustrated correspond to those of FIG. 2*a*.

Figure 3A:
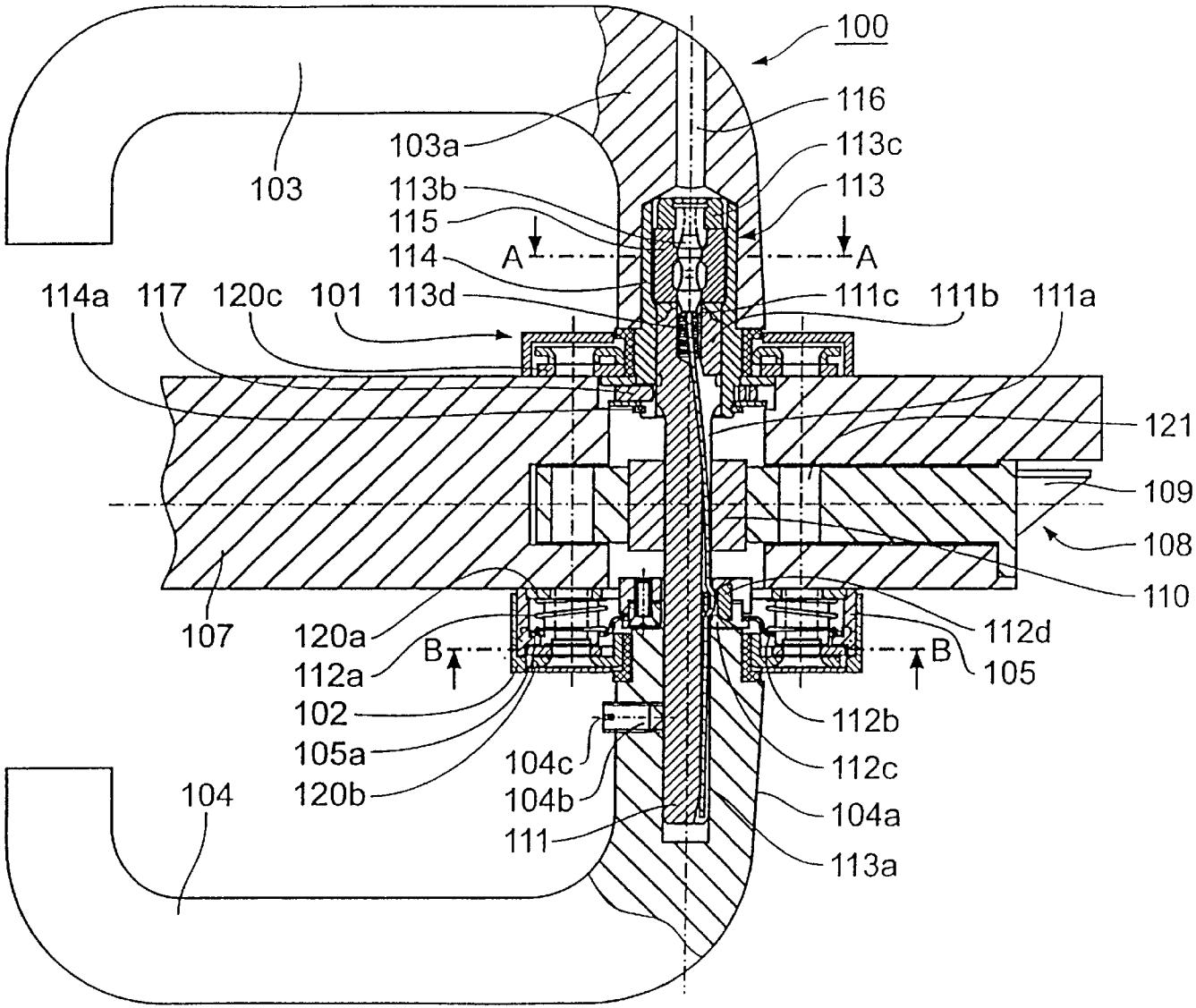
FIGS. 3*a* to 3*j* show, partly as illustrated details, sectional illustrations of a door fitting with a changeover device according to one embodiment of the invention in various switching states and views.
Figure 3B:
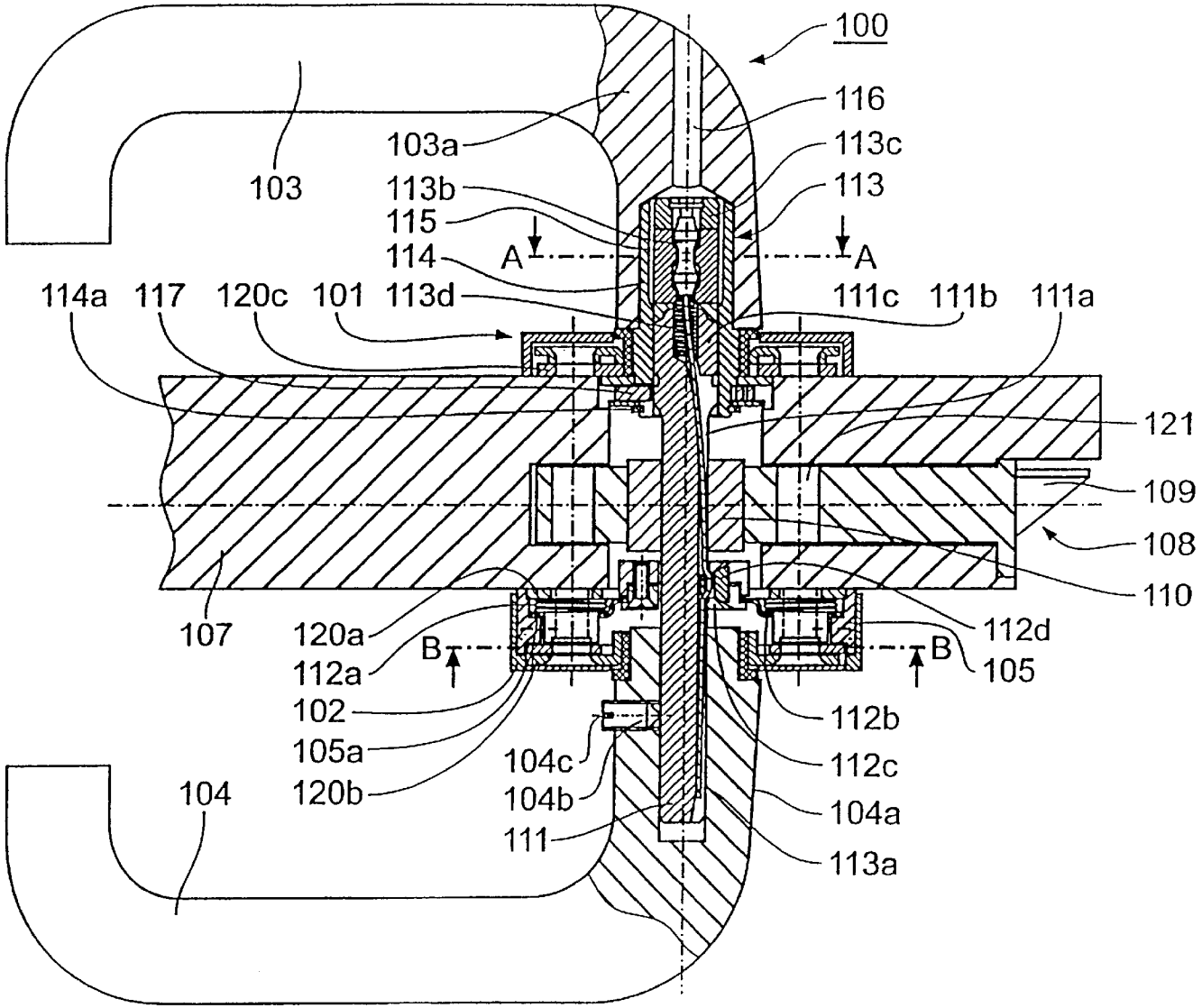
Figure 3C:
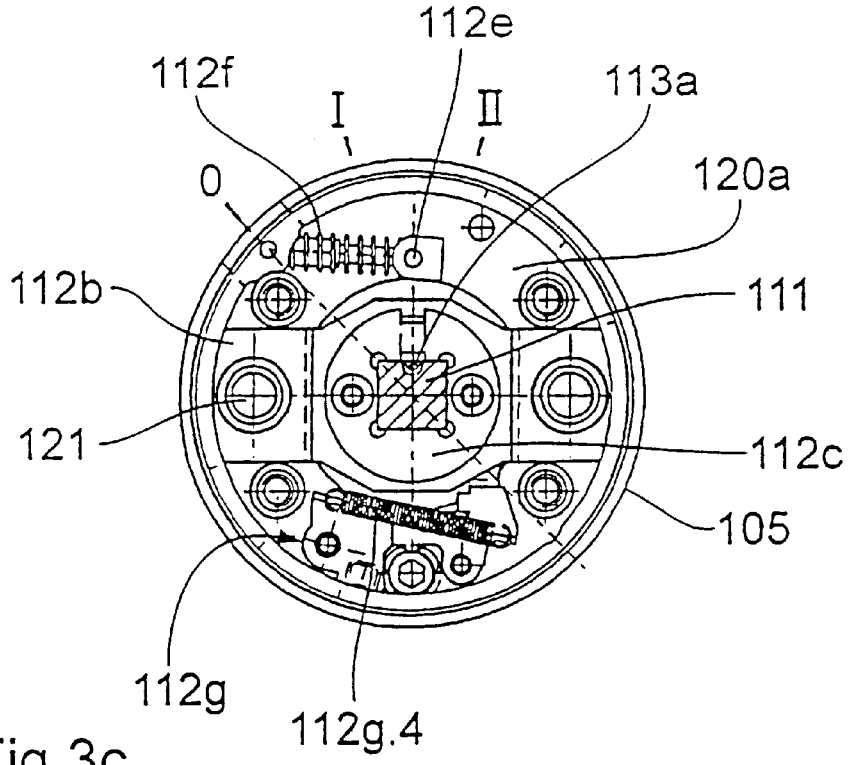
Figure 3D:
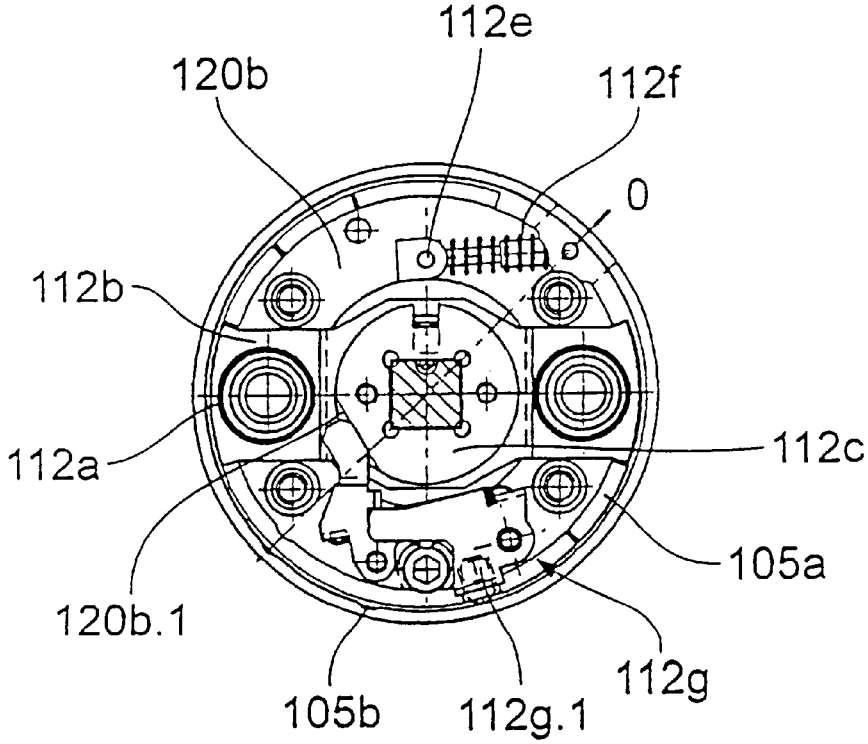
Figure 3E:
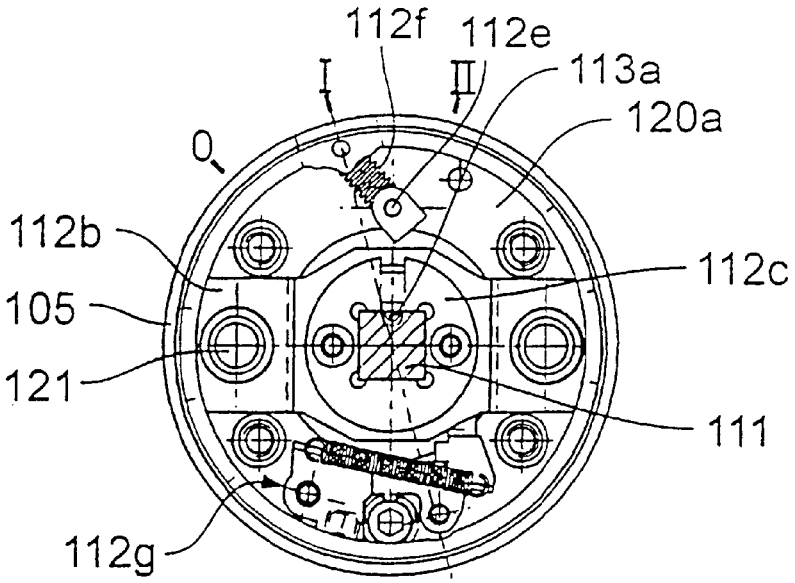
Figure 3F:
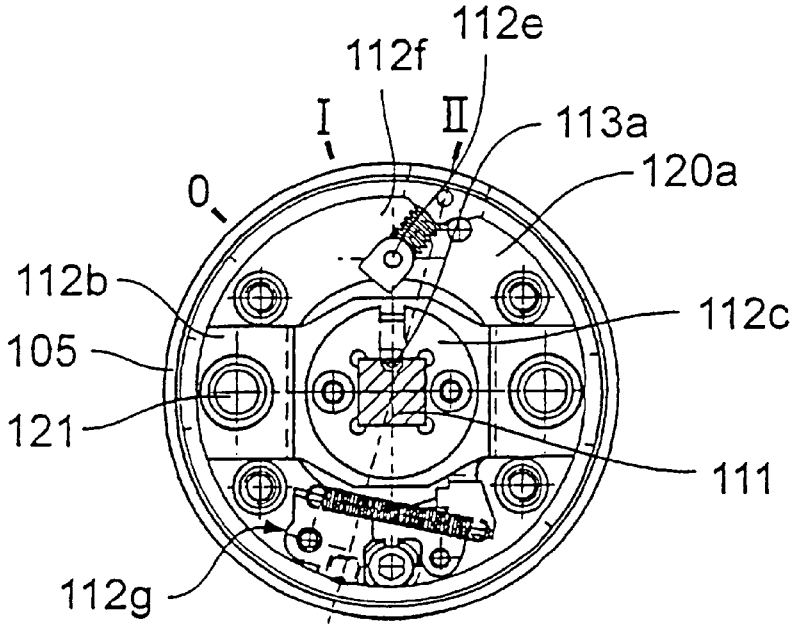
Figure 3G:
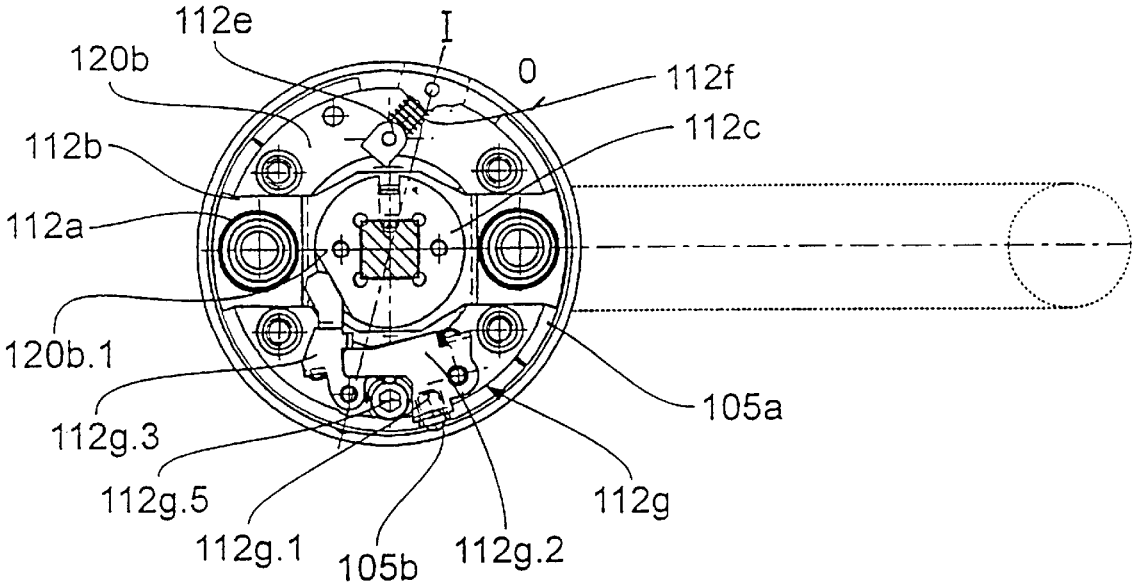
Figure 3H:
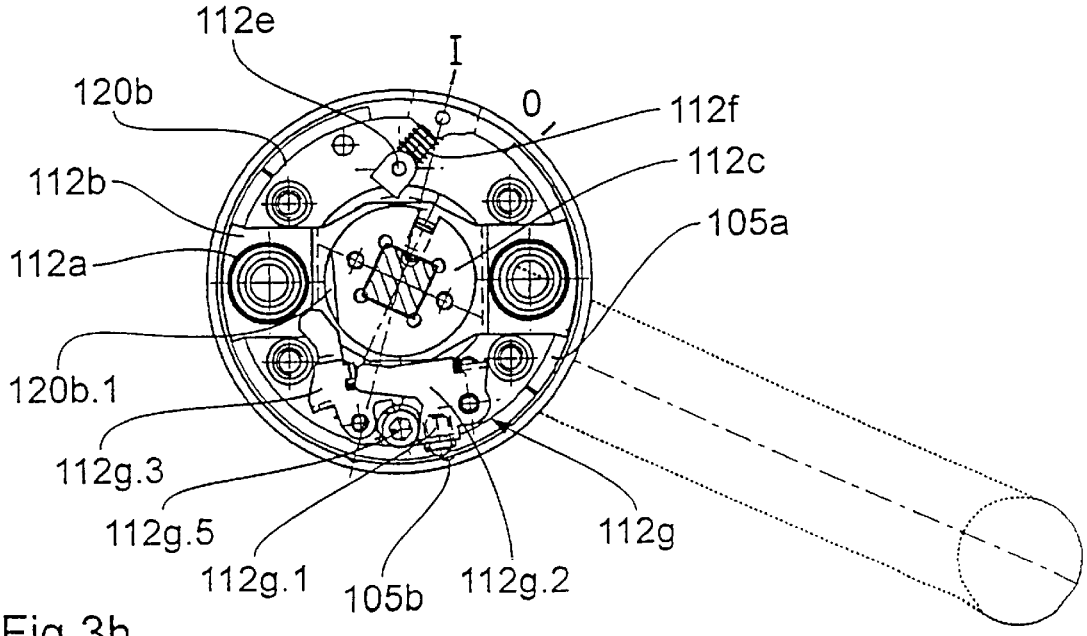
Figure 3I:
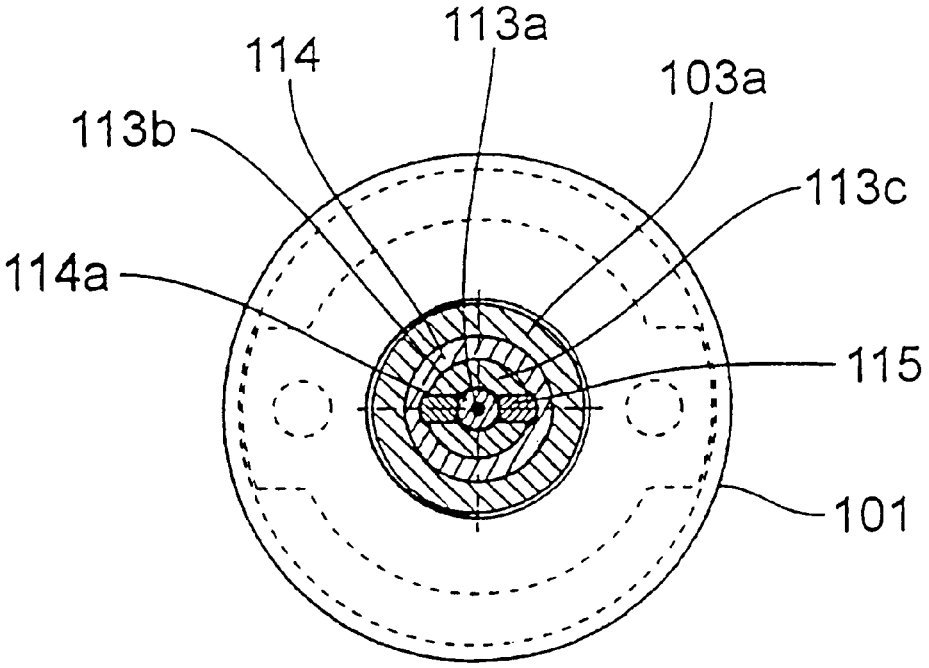
Figure 3J:
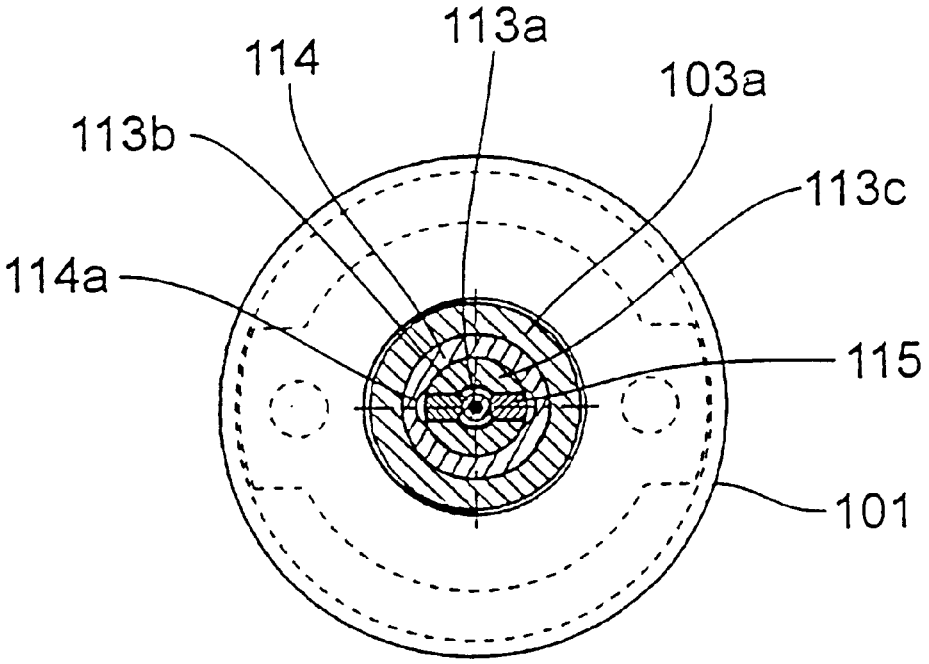

FIGS. 3*a* and 3*b* show, in sectional illustrations along a horizontal sectional plane perpendicular to the plane of the door leaf, a door fitting 100 with a changeover device according to one embodiment of the invention in the two switching states "active" (FIG. 3*a*) and "inactive" (FIG. 3*b*), the square spindle, together with the parts assigned to it, being illustrated rotated through 90° in order to show its shape more clearly. FIGS. 3*c* and 3*d* show the design of the actuating means in the vertical plan B—B of FIG. 3*a* in the "active" position, as seen from inside the room (FIG. 3*c*) and from the door leaf (FIG. 3*d*), FIGS. 3*e* and 3*f* show the design of the actuating means, as seen from inside the room, in the "inactive/unstable" position (FIG. 3*e*) and the "inactive/stable" position (FIG. 3*f*), FIGS. 3*g* and 3*h* show the actuating means, as seen from the door leaf, in the "inactive/unstable" position before (FIG. 3*g*) and during (FIG. 3*h*) the actuation of the internal handle, and FIGS. 3*i* and 3*j* are cross-sectional illustrations of the coupling means in the vertical plan A—A in FIGS. 3*a* and 3*b* in the "active" and "inactive" positions respectively.

A description is given only for the structural parts of the changeover device which are essential to its functioning from the point of view of the invention, in particular inasmuch as the arrangement and interaction of said changeover device cannot be inferred readily from the drawings. Parts or subassemblies which have already been shown diagrammatically in FIG. 1*a* or FIG. 2*a* are designated by reference numerals referred to these Figures (that is to say, for example, by the numeral 101 referring to numeral 1, numeral 102 corresponding to numeral 2, etc.).

The fitting 100 shown in FIGS. 3*a* to 3*j* corresponds in many parts to a conventional door fitting and is used with a conventional latch lock 108 having a latch 109 and a follower 110.

A modified square spindle 111 of a lock has, on its top side (to be seen as the righthand side in the FIG. as a result of the above-mentioned rotation through 90° to the drawing), a recess 111*a*, in which a pullcord 113*a* runs. At a cylindrically designed end 111*b* of the square spindle, said end facing a coupling means (described further below), the recess 111*a* opens into a central bore 111*c* having a widened diameter. In the region of the fitting 100, where, in the assembled state of the fitting, the square spindle 111 surrounds a rotary ring 105 as an actuating element of the changeover device, there is provided a clamping block 112*d* which can be clamped by means of the pullcord 113*a* and by which, when the fitting parts on the inside of the door are being assembled, a connection is made between the pullcord 113*a* and the actuating means of the changeover device and, at the same time, the active cord length is set in adaptation to the thickness of the door leaf 107.

The rotary ring 105 provided with an axial cam 105*a* and having a design ring 102 connected so as to transmit torque, is mounted rotatably and in an axially secured manner between a first case plate 120*a* and a second case plate 120*b*, this arrangement being connected to an abutment 120*c* on the outside of the door by means of an abutment place 120*f* for receiving the bearing collar of the internal lever handle 104 via two screws 121 passing through the door leaf 107. A threaded bore 104*b* for receiving a set screw 104*c* is provided in a known way in the internal lever handle neck 104*a*, by means of which set screw the internal pressdown handle (internal lever handle) 104 is connected to the square spindle 111 fixedly in terms of rotation and so as to be secured against axial displacement or against being pulled off.

The rotary ring 105 has, inside it, a free end face which is provided with two identical cam tracks located opposite one another and onto which a cord block plate 112*b* is pressed by means of two strong compression springs 112*a* supported against the first case plate 120*a*. The axial position of this cord block plate is thus determined by the rotary angle position of the cam tracks on the inner end face 105*a* of the rotary ring 105, that is to say, ultimately, by the rotary position of the latter. The cord block plate has a wide concentric bore, in which is received a two-part cord block 112*c*, between the two screwed-together parts of which the above-mentioned clamping block 112*d*, guided in the recess 111*a* of the square spindle 111, rests. The axial position of the cord block plate 112*b* thus at the same time determines that of the clamping block 112*d* and, since the pullcord 113*a* is fixed axially in the clamping block, that of the pullcord 113*a*. A rotation of the rotary ring 105 is thereby ultimately converted into an axial displacement of the pullcord 113*a* and (as explained further below) a switch slot assembly 113*b*.

The bistable and stable behaviors of the changeover device which ensure switching are implemented by the interaction of a compression spring member 112*f* connected at one end to the rotary ring 105 and pivotable at the other end about an axis 112*e*, and of a combined detent and trip mechanism 112*g* which interacts with a cam edge 120*b*.1 on the cord block, on the one hand, and, by means of a spherical thrustpiece 112*g*.1, with two grooves 105*b* in the inner cylindrical surface of the rotary ring 105, on the other hand.

The combined detent and trip mechanism 112*g* has a rotatably mounted pivoting detent lever 112*g*.2, with a spherical thrustpiece 112g.1, and a rotatably mounted strap-type trip lever 112g.3. By means of a tension spring 112g.4 connecting the ends of the pivoting detent lever 112g.2 and the strap-type trip lever 112g.3 which face away from one another, the detent and trip mechanism 112g is designed as a self-tensioning system. This subassembly serves for setting the bistable state (position "I";

FIGS. 3e, 3g) and for canceling this in response to specific external action and causes the changeover device to jump automatically out of the position "I"into the position "0". In the version illustrated, the specific external action is, in particular, the pressing down of the internal lever handle 104, as shown in the added part of FIG. 3h. In this case, the strap-type trip lever 112g.3 is pivoted by the cam edge 120b.1, with the result that, the pivoting detent lever 112g.2 loses its support and the spherical thrustpiece comes out of engagement with the groove 105b in the inner cylindrical surface of the rotary ring 105.

The same effect is achieved by rotating the shaft 112g.5, provided externally with cams and with an inner hexagon, by means of a suitable adjusting element or device, via which a torque is exerted on the shaft 112g.5. This allows an electro-magnetic trip, an automatic release of the snap bolt or manual safety release from outside the door.

In contrast to the internal lever handle 104, the external lever handle 103 is not permanently connected fixedly in terms of rotation to the square spindle 111, but its pressdown handle neck 103a has a widened blind bore, into which is inserted, fixedly in terms of rotation, a sleeve 114 which is mounted radially in the external lock cover 101 and is fixed axially via a shaft retaining ring 114a. The sleeve 114 at the same time forms the outer sheath of a coupling means, via which a rotationally fixed connection to the square spindle 111 is selectively made ("active" switching or operating state) or broken ("inactive" switching or operating state).

The coupling means 113 comprises a switch slot assembly 113b (the design of which can be seen clearly in FIGS. 3a and 3b) which is fixedly connected to that end of the pullcord 113a located outside the door and which has a rotationally symmetrical, in particular stepped shape, a coupling inner sleeve 113c which guides the switch slot assembly radially, lengthens the square spindle 111 axially and is connected fixedly in terms of rotation to the latter, and a helical compression spring 113d held in the central bore 111c of the square spindle 111 and surrounding that end of the pullcord 113a located outside the door. Provided as operative elements for making the connection between the sleeve 114 and the square spindle 111 are two stop blocks 115 which are arranged opposite one another on the circumference of the switch slot assembly and which are mounted in the coupling inner sleeve 113c. As may be seen, for example, from FIG. 3a in conjunction with FIG. 3i, the basic shape of the stop blocks 115 is parallelepedic with rounded edges and with inner faces worked out according to the steps in the radius of the switch slot assembly. The sleeve 114 has, on its inner cylindrical surface, two recesses 114a which correspond to the shape and position of the stop blocks 115 and merge in a beveled manner into the remaining regions of the inner cylindrical surface and into which the stop blocks 115 can be engaged by the switch slot assembly 113b and out of which they can be pressed inward again during a rotational movement of the sleeve 114 (that is to say, of the external lever handle 103). The compression spring 113d is supported between the door-side end face of the switch slot assembly 113b and the bottom of the bore 111c and presses the switch slot assembly away from the door leaf.

Interaction between the pullcord 113a and the compression spring 113d results, depending on the rotary position of the rotary ring 105 and on the axial position of the pullcord 113a brought about thereby, in the two switching positions shown in FIGS. 3a and 3i or 3b and 3j: in the switching position according to FIGS. 3a, 3i, the pullcord is drawn inward counter to the force of the compression spring 113d (so as to overcome said force), with the result that the regions of greatest radial extent of the switch slot assembly 113b come into a position corresponding axially to the inwardly projecting portions of the stopblocks 115 and the stopblocks are pressed radially outward into the recesses 114a of the sleeve 114 by the switch slot assembly. Thus, in this switching position, the inner sleeve 113c and therefore the square spindle 111 are connected fixedly in terms of rotation to the sleeve 114 and thus to the external lever handle 103 by means of the stopblocks, so that the external lever handle becomes active. In the position shown in FIGS. 3b, 3j, the pullcord 113a is not drawn inward, so that the switch slot assembly 113b is pressed outward by the force of the compression spring 113d. Its regions of greatest radial extent thus come to rest in correspondence with the recess portions of the stopblocks 115, so that these are not pressed any longer into the recesses of the sleeve 114. If the external lever handle is actuated in this position, that is to say the sleeve 114 rotated, its inner cylindrical surface runs virtually without any resistance on the stopblocks 115, with the result that these are pressed inward directly out of the recesses 114a. Consequently, the inner sleeve 113b (and therefore the square spindle 111) is uncoupled from the sleeve 114 and therefore from the external lever handle 103, and the latter moves idly.

The external lever handle 103 has, as a prolongation of the longitudinal axis of the switch slot assembly 113b, an outwardly continuous bore 116, into which can be introduced an elongate article of corresponding dimensions, by means of which a pressure directed axially inward can be exerted on the switch slot assembly 113b. As a result, according to the principle shown in FIG. 2a, the switch slot assembly is displaced axially from outside and, via the outward pressing of the stopblocks 115 which is associated therewith, the rotationally fixed connection between the square spindle 111 and the external lever handle 103 is made, irrespective of the position of the internal actuating element, and a safety opening function can be performed.

The sleeve 114, together with the coupling means 113 and the operative elements 113b received therein, can be used as an integral subassembly in a wide variety of external handles and by means of various principles for rotationally fixed connection which are adapted to the respective fitting system. Said sleeve may, in particular, have a structured outer wall surface and be pressed together with the handle or the latter shrunk onto the sleeve.

In the exemplary embodiment described above, the stopblocks 115 are designed in such a way that inserting them so as to be rotated through 180° leads to a reversal of the "active" and "inactive" operating states.

The design of the external fitting, including the mounting of the external lever handle, is conventional and is not described here. It is merely pointed out that, in the version illustrated, a helical spring 117 surrounding the bush or sleeve 114 and prestressing the external lever handle into the horizontal position is provided for generating an ergonomically appropriate counterpressure during actuation and for assisting the return of the external lever handle 103 into the position of rest in the fitting.

The invention is not restricted in its implementation to the preferred exemplary embodiment specified above. On the contrary, a number of variants, making use of the solution illustrated, even in fundamentally different versions, are conceivable.

In particular, the changeover device may also be used with conventional door, gate or window fittings which have a design differing sharply from the versions described and/or additional functions, for example with safety door fittings, so-called panic locks (with the possibility of unlocking the key actuated lock by actuating the pressdown handle), etc. In the case of door or window fittings with roses, the device can be produced basically in the same way as described above for door fittings with lock covers.

What is claimed is:

1. A changeover device for a fitting of a door, gate, or window, with the fitting having an internal handle and an external handle, with each of the internal and external handles being fixed axially, the changeover device for drawing back a bolt element of a lock, the changeover device comprising:

an actuating shaft, extending between the internal and external handles, for drawing back the bolt element, a predetermined external dimension of a predetermined region of the actuating shaft being the only dimension of the changeover device for fitting into a predetermined opening of the lock;

an actuating element, associated with the internal handle, for selectively setting the external handle to one of at least two selectable operating states, in one of said selectable operating states said external handle being locked while said internal handle is unlocked;

transmission means which extends, at least in the predetermined region of the actuating shaft fitting into the opening of the lock, between the internal and external handles within the predetermined external dimension of the actuating shaft, wherein the transmission means is connected to the actuating element for transmitting forces; and coupling means, being integrated as a closed unit into the external handle, for operating with the actuating element to select the operating state of the external handle from the at least two selectable operating states, for selectively connecting or uncoupling the external handle and actuating shaft, and for rotating the external handle in the selected operating state.

2. The changeover device of claim 1 wherein the transmission means includes a force transmission element; and wherein the coupling means includes a directional detente mechanism movable by the force transmission element.

3. The changeover device of claim 2 further comprising:

a return member, including a spring element, which automatically applies a force counter to a direction of action of the actuating element and the transmission element in setting the selectable operation state of the external handle.

4. The changeover device of claim 2, wherein the transmission element is a pullable element running substantially parallel to a longitudinal axis of the actuating shaft and through a recess of the actuating shaft.

5. The changeover device of claim 1, wherein the coupling means includes a first engagement part which selectively engages a spindle of the actuating shaft by a spring-actuated snap bolt fixedly connected to the actuating shaft.

6. The changeover device of claim 5, wherein the coupling means includes a second engagement part which is fixedly connected to the transmission element and which is movable by the transmission element between at least two different predetermined positions, thereby changing a state of engagement of the second engagement part with the first engagement part.

7. The changeover device of claim 1, wherein the actuating element includes a rocker lever having a common axis of rotation with the internal handle, wherein the internal handle includes a pressdown handle.

8. The changeover device of claim 1, wherein the actuating element is selectably movable between a predetermined active state and a predetermined inactive state by the external handle.

9. The changeover device of claim 1, wherein the actuating element includes means for being selectively fixedly reset between a predetermined active state and a predetermined inactive state by the external handle.

10. The changeover device of claim 1, wherein the actuating element includes a detente-and-return mechanism for the selective setting of a bistable function changeover state which automatically places the actuating element into a first position when the internal handle is actuated by the bolt element of the lock.

11. The changeover device of claim 1, wherein the actuating element is symmetrical for providing symmetrically selectable operation in the direction of actuation.

12. The changeover device of claim 1, wherein the coupling means is symmetrical for providing symmetrical interaction with symmetrical internal and external handles for operation of the actuating element in any orientation.

13. The changeover device of claim 1, further comprising:

changeover means for performing at least unidirectional changeover between two predetermined operating states, including a predetermined changeover from a predetermined inactive state to a predetermined active state using the external handle.

14. The changeover device of claim 13, wherein the external handle includes a housing with an orifice therein, through which the operative element is movable to different positions by a key-actuated lock cylinder.

15. The changeover device of claim 1, further comprising:

indicator means including a sensor for performing remote interrogation of the operating state of the actuating element through a connection to a control system.

16. The changeover device of claim 1, further comprising:

means for remote actuation of the actuating element using a radio device.

17. A combination fitting of a door, gate, or window and the changeover device as claimed in claim 1.

18. The combination fitting and changeover device of claim 19, wherein the internal and external handles are pressdown handles pivotable about a common horizontal axis of rotation and operatively connected to the actuating shaft.

19. A combination changeover device and fitting of a door, gate, or window, with the fitting having an internal handle and an external handle, with each of the internal and external handles being fixed axially, the changeover device for drawing back a bolt element of a lock, the changeover device comprising:

an actuating shaft for drawing back the bolt element with a predetermined region of the actuating shaft fitting into a predetermined opening of the lock, wherein the actuating shaft receives and absorbs external forces applied to the internal and external handles for directing the absorbed forces in a direction between the internal and external handles;

an actuating element for selectively setting the external handle to one of at least two operating states, in one of said selectable operating states said external handle being locked while said internal handle is unlocked;

transmission means connected to the actuating element and extending between the internal and external handles; and coupling means for selecting the operating state of the external handle from the at least two operating states, and for selectively connecting or uncoupling the external handle and actuating shaft to rotate the external handle in the selected operating state.

20. A changeover device for a fitting of a door, gate, or window, with the fitting having switchable actuating means disposed between an inner handle and an outer handle, the changeover device for retracting a bolt element of a lock, the changeover device comprising:

a compact, axially non-translatable actuating shaft disposed between the outer handle and the inner handle, wherein the actuating shaft is monolithically formed as a one-piece element;

wherein the actuating shaft absorbs external compressive, tensile, bending and torsion forces applied to the inner and outer handles and transmits the forces in a direction between the inner and outer handles;

wherein the actuating shaft penetrates a follower, with the actuating shaft being rotationally symmetric relative to a predetermined side portion of the outer handle and extending continuously from the outer handle to the inner handle, so as to transmit torque generated by a force applied to at least one of the inner and outer handles to the follower; and a coupling means associated with the outer handle and forming a closed unit with the outer handle for selecting an operating state of the outer handle and for selectively coupling and decoupling the outer handle and the actuating shaft, wherein the outer handle rotates freely in each of the operating states such that in one of said selectable operating states said external handle is locked while said internal handle is unlocked.

21. The changeover device of claim 20, further comprising:

transmission means including:

a transmission element guided in a recess along an outer contour of the actuating shaft, wherein the transmission element extends unobstructed along the profiled actuating shaft and through the follower having an inner profile;

wherein the transmission element is inserted in a selectable position into an inner actuating element disposed on the outer contour of the profiled actuating shaft, wherein the actuating element is associated with the inner handle for selectively setting at least two operating states of the outer handle, and with the actuating element enclosing the actuating shaft, with the actuating shaft having an inner protrusion; and wherein the actuating element is affixed to an inside portion of the fitting.

22. The changeover device of claim 20, wherein the transmission means includes a transmission element for receiving forces, and the transmission means is connected to the coupling means for causing the selection of the operating state.

23. The changeover device of claim 20, wherein the actuating element is responsive to movement of the outer handle to be selectively set to a predetermined active state or to a predetermined inactive state when the outer handle is moved to at least one position, including a predetermined normal position.

24. The changeover device of claim 20, wherein the actuating element includes a detente-and-return mechanism for the selective setting of a bistable function changeover state which automatically places the actuating element into a first position when the inner handle is actuated by the bolt element of the lock.

25. The changeover device of claim 20, further comprising:

changeover means for performing at least unidirectional changeover between two predetermined operating states, including a predetermined changeover from a predetermined inactive state to a predetermined active state using the outer handle.

26. The changeover device of claim 25, wherein the outer handle includes a housing with an orifice therein, through which the operative element is movable to different positions by a key-actuated lock cylinder.

27. The changeover device of claim 20, further comprising:

indicator means including a sensor for performing remote interrogation of the operating state of the actuating element through a connection to a control system.

28. The changeover device of claim 20, further comprising:

means for remote actuation of the actuating element using a radio device.

29. A combination fitting for a door, gate, or window and the changeover device of claim 20.

* * * * *